United States Patent [19]

Beach, Jr. et al.

[11] Patent Number: 4,936,106

[45] Date of Patent: Jun. 26, 1990

[54] RETRACTABLE CONTROL UNIT FOR REFRIGERATORS

[75] Inventors: Sammie C. Beach, Jr., Gowen; Donald J. Olsen; Edward P. Wuesthoff, both of Greenville; Terry Mitchell, Jenison, all of Mich.

[73] Assignee: White Consolidated Industries, Inc., Cleveland, Ohio

[21] Appl. No.: 400,087

[22] Filed: Aug. 29, 1989

[51] Int. Cl.[5] ..... F25B 49/00

[52] U.S. Cl. ..... 62/131; 62/187; 62/441; 200/293; 337/327

[58] Field of Search ..... 62/187, 125, 126, 127, 62/229, 441, 443, 444, 447, 131; 236/51, 94; 165/11.1; 337/20, 34, 112, 327, 380, 398, 414; 200/293, 296; 206/328, 329, 320

[56] References Cited

U.S. PATENT DOCUMENTS

| | | | |
|---|---|---|---|
| 2,720,089 | 10/1955 | Morton | 62/131 |
| 3,447,747 | 6/1969 | McHale | 62/187 X |
| 3,815,669 | 6/1974 | Lindenschmidt | 62/447 X |
| 4,014,178 | 3/1977 | Kells | 62/441 X |
| 4,689,966 | 9/1987 | Nonaka | 62/187 |

*Primary Examiner*—Harry B. Tanner

*Attorney, Agent, or Firm*—Pearne, Gordon, McCoy & Granger

[57] ABSTRACT

A retractable temperature control for refrigeration units includes a control panel pivoted for movement between an extended, accessible position and a retracted position in which it is enclosed within one of the insulated walls of the unit. Mounted on the panel are two operators, one of which controls the temperature of a thermostat and the other of which controls the position of a damper. Adjustment of the operator associated with the thermostat controls the temperature of one compartment in the refrigeration unit and adjustment of the other operator controls the position of a damper, and in turn controls the differential temperature between the two compartments provided by the refrigeration unit. The thermostat and the damper control are structured so that movement of the control panel between the retracted and extended positions does not affect the adjustment thereof. When the controls are in the retracted position, they do not interfere with the placement of articles stored within the refrigeration compartments. Further, retraction of the controls prevents accidental damage of the controls and/or accidental change in the adjusted positions thereof.

16 Claims, 5 Drawing Sheets

RETRACTABLE CONTROL UNIT FOR REFRIGERATORS

BACKGROUND OF THE INVENTION

This invention relates generally to controls for refrigerators and the like, and more particularly to a novel and improved retractable temperature control for refrigerators and freezers.

Prior Art

Typical refrigerator/freezer combinations provide cabinets having insulated walls which define a freezer compartment and a separate compartment for storing non-frozen food, hereinafter referred to as a "food compartment." One typical arrangement provides a food compartment in the lower portion of the cabinet and a freezer compartment in the upper portion thereof above the food compartment. Another typical arrangement positions the two compartments in a side-by-side relationship. With both arrangements, an insulated separator wall is positioned between the two compartments, and separate doors are usually mounted on the cabinet to provide separate access to the two compartments.

Typically, a single refrigeration unit is provided to cool both compartments, with the evaporators of such unit installed in or adjacent to the freezer compartment. Duct means connect the compartments so that the food compartment is also cooled from the evaporators contained within or adjacent to the freezer compartment. Typically also a thermostat is positioned in one of the compartments to control the temperature thereof by controlling the operation of the compressor of the refrigeration unit. An adjustable damper in the duct system is usually provided to control the temperature of the other compartment by adjusting the proportions of the cooling supplied to the two compartments, thereby adjusting the differential temperature between the two compartments. Further, it is typical to provide the thermostat in the food compartment, since the temperature control of such compartment must be more accurately maintained.

It is also typical to mount the controls so that they project into at least one of the compartments (typically, the food compartment) to provide user access for their adjustment. Since the controls project into the compartment, they can interfere with the storage of food in the compartment and are sometimes inadvertently bumped, damaging the controls or changing the control temperature when the user is not aware of such fact.

SUMMARY OF THE INVENTION

The present invention provides a novel and improved control system for refrigerators and the like in which the controls are supported for retraction into the wall of the refrigerator after the adjustment thereof has been completed. The control operators are movable to an extended position in which they are accessible to the user for adjustment. With such system, the temperature controls for the refrigerator do not interfere with the storage of food and are not inadvertently damaged or changed in their temperature adjustment.

The illustrated embodiment of this invention is a combination refrigerator/freezer in which the freezer compartment is in the upper portion of the cabinet and the nonfreezing food storage compartment is in the lower portion of the cabinet. The two compartments are separated by an insulated separator wall. The evaporator of the refrigerating unit is located in the freezer compartment and a duct system communicates between the non-freezing food storage compartment and the evaporator.

A retractable control system is provided which includes an adjustable thermostat operable to sense the temperature in the food storage compartment and control the temperature thereof by controlling the operation of the compressor of the refrigeration unit. A control is also provided for adjusting the position of the damper located in the duct system connecting the two compartments. Adjustment of this damper provides user adjustment of the differential temperature between the two compartments, and thereby provides user adjustment of the temperature in the freezer compartment.

The operators of the two controls are mounted on a retractable control panel pivotally mounted in the separator wall. In the retracted position, the control panel and the control operators are enclosed within the separator wall, and do not project into either of the compartments. In the extended position of the control panel, however, the control operators project into the food storage compartment and are accessible for adjustment. Further in the illustrated embodiment, a power saver switch mounted on the control panel is user-accessible when the housing is in the extended position and is enclosed within the separator wall when the control housing is in the retracted position. The controls are structured so that movement between the extended and retracted positions does not change the temperature adjustment of the controls.

With this invention, a simple, reliable, and durable structure is provided in which the refrigerator controls are fully and easily accessible when adjustment of the controls is required, and are fully enclosed within the wall structure of the refrigerator so that they do not interfere with the storage or use of the compartments when user adjustment is not required.

These and other aspects of this invention are illustrated in the accompanying drawings, and are more fully described in the following specification.

DETAILED DESCRIPTION OF THE DRAWINGS

Figure 2:
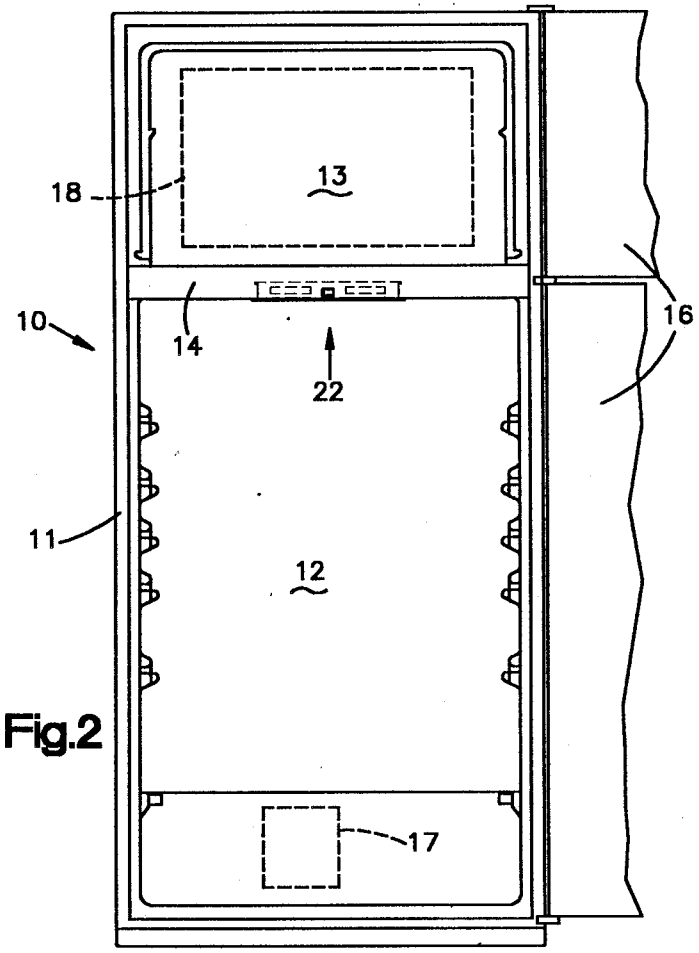
FIG. 2 is a view similar to FIG. 1, but illustrating the adjustable control in its retracted or recessed position.
Figure 1:
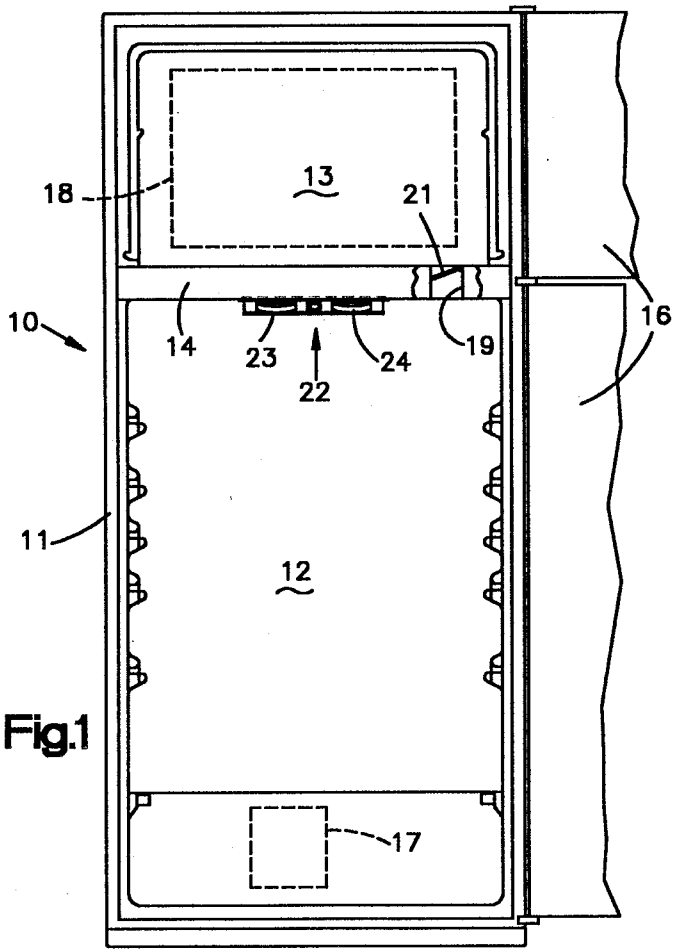
FIG. 1 is a front elevation of a refrigerator/freezer combination incorporating the present invention, illustrating the adjustable control in the extended position.

FIGS. 1 and 2 illustrate a typical refrigerator 10 having walls 11 defining a lower compartment 12 and an upper compartment 13. In this illustrated embodiment, the upper compartment 13 is a freezer compartment and the lower compartment 12 is a food compartment for the storage of unfrozen food at a temperature above freezing temperature. The two compartments 12 and 13 are separated by an insulated separator wall 14. Separate access to the two compartments 12 and 13 is provided by doors 16.

The refrigerator is cooled by a schematically illustrated refrigeration unit including a compressor 17 mounted in the lower portion of the unit and an evaporator 18 mounted in the freezer compartment 13. A schematically illustrated duct system 19 connects the food storage compartment 12 with the zone of the evaporator 13 so that a portion of the cooling provided by the evaporator is available to cool the food storage compartment 12. An adjustable damper or paddle wheel schematically illustrated at 21 adjustably determines the proportion of the cooling provided by the evaporator which is delivered to the food storage compartment 12. A thermostat (discussed in detail below) provides a sensor which senses the temperature in the food storage compartment 12 and controls the operation of the compressor 17 to maintain the desired temperature in such compartment. The adjustment of the damper 21, on the other hand, adjusts the differential temperature between the two compartments 12 and 13, and consequently adjusts the temperature of the freezer compartment.

It is typical to provide a thermostat to control the temperature in the food storage compartment because such compartment must be maintained at a temperature which is closely regulated. If the temperature becomes too cold, food in the compartment freezes and if it becomes too warm it spoils. On the other hand, changes in the freezing temperature within the freezer compartment 13 do not adversely affect the storage of the frozen food contained therein so long as the temperature is low enough to maintain the food in a frozen condition. Consequently, the temperature of the freezer compartment does not require a close control.

In accordance with the present invention, a retractable control system is provided which includes a retractable control panel 22 movable between an extended position projecting down into the food storage compartment 12, as illustrated in FIG. 1, and a retracted position in which it is enclosed by the separator wall 14, as illustrated in FIG. 2. Mounted on the control panel 22 is an operator 23 for the thermostat controlling the temperature of the food storage compartment and an operator 24 controlling the position of the damper 21, and thereby controlling the temperature of the freezer compartment 13. As indicated in FIG. 1, the two operators are accessible in the food storage compartment when the control panel is extended and, as illustrated in FIG. 2, the operators and the control panel are enclosed within the separator wall 14 in the retracted position.

Figure 3:
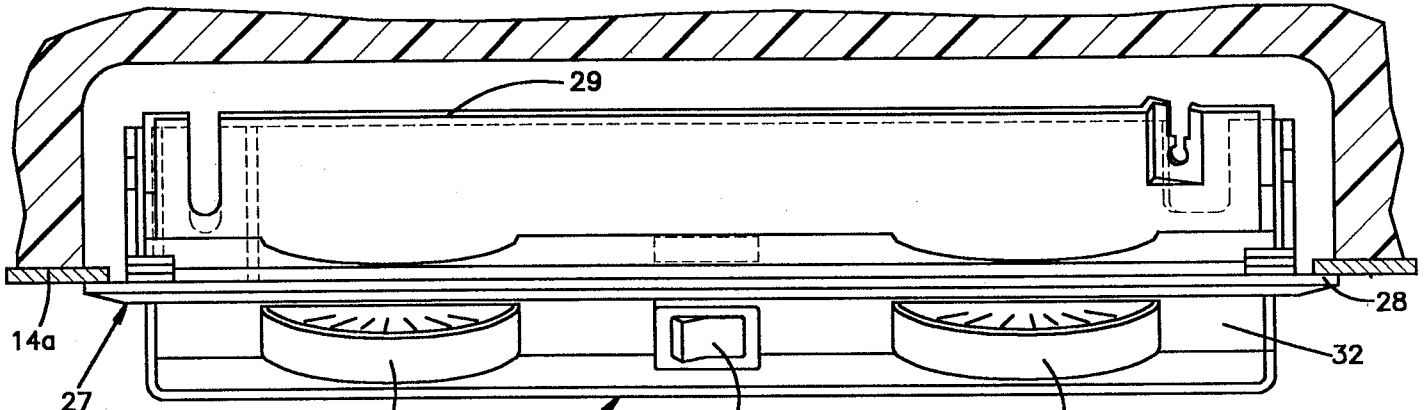
FIG. 3 is an enlarged, fragmentary front elevation of the control panel in the extended position.
Figure 4:
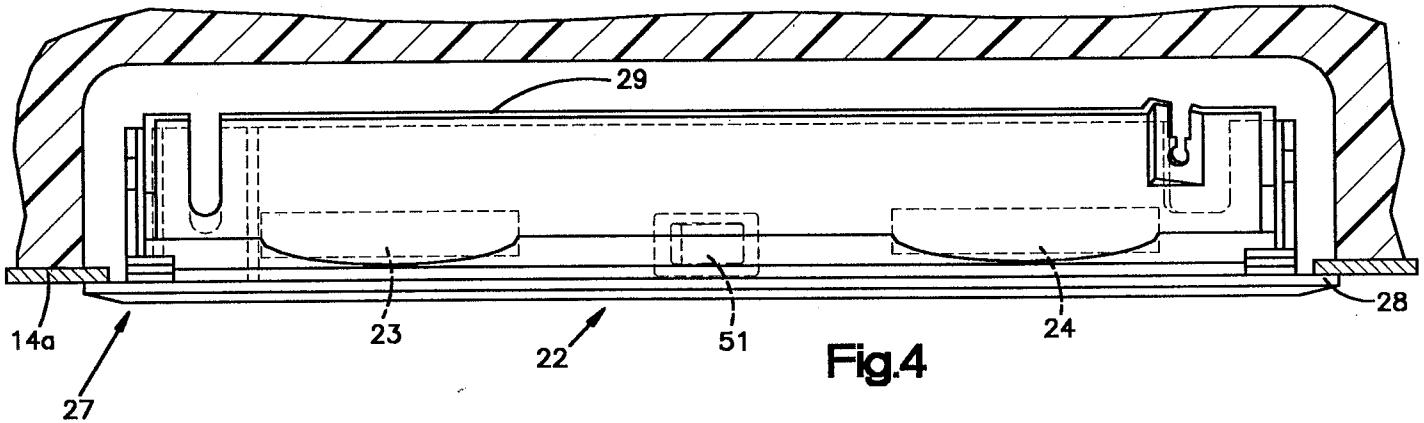
FIG. 4 is a view similar to FIG. 3, but illustrating the control in its retracted position.
Figure 5:
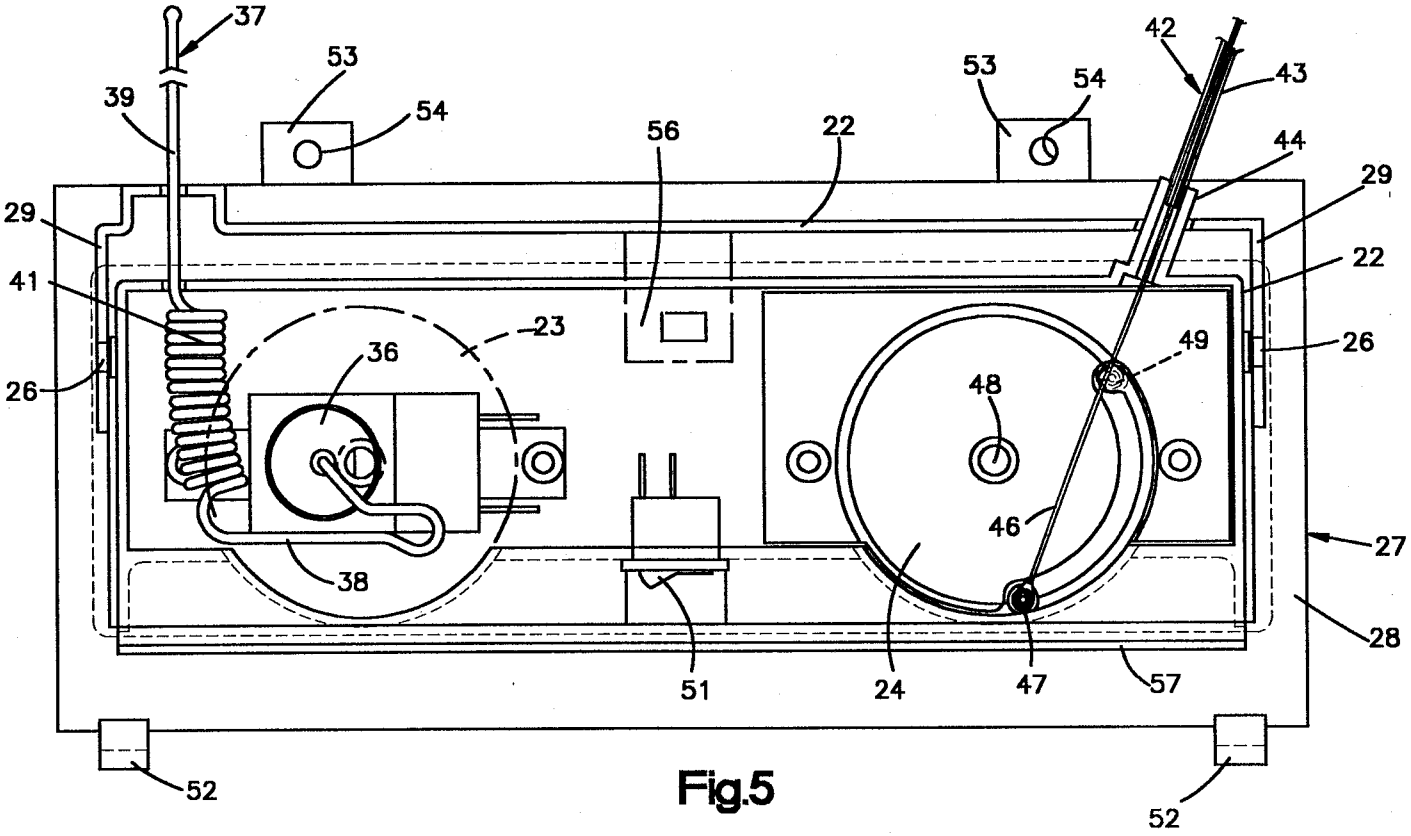
FIG. 5 is a fragmentary plan view, illustrating the placement of the control components and their general structure and operation.

Reference should now be made to FIGS. 3 through 9, which illustrate the structural detail of the control panel and the controls themselves. The control panel 22 is generally rectangular in shape and is provided with a pair of opposed pivots 26 which pivotally mount the control panel in a mounting frame 27. The mounting frame 27 is also generally rectangular in shape, as best illustrated in FIG. 5, and provides a rectangular border structure 28 that defines a rectangular opening in which the control panel 22 is positioned. The mounting frame is also provided with opposed, upstanding wall portions 29 at each end of the mounting frame having openings through which the pivots 26 extend to provide the pivotal mounting structure.

The frame 27 provides a pair of forward tabs 52 which fit over the lower wall 14a of the separator wall 14 and rearward tabs 53 which have screw holes 54. The frame is easily mounted on the separator wall within an opening therein by inserting the tabs 52 and then installing screws in the tabs 53.

Figure 6:
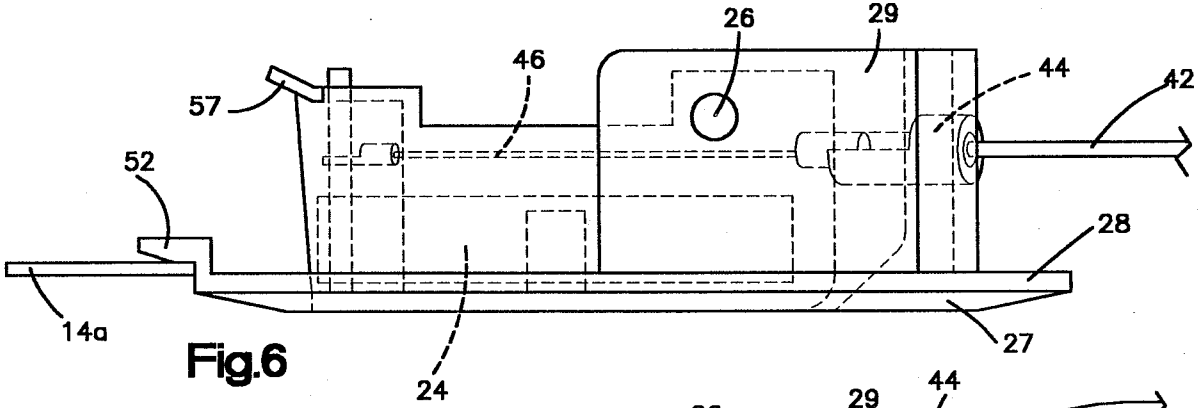
FIGS. 6 and 7 are end views, respectively illustrating the freezer temperature control end of the control system in the retracted position and extended operative position.
Figure 7:
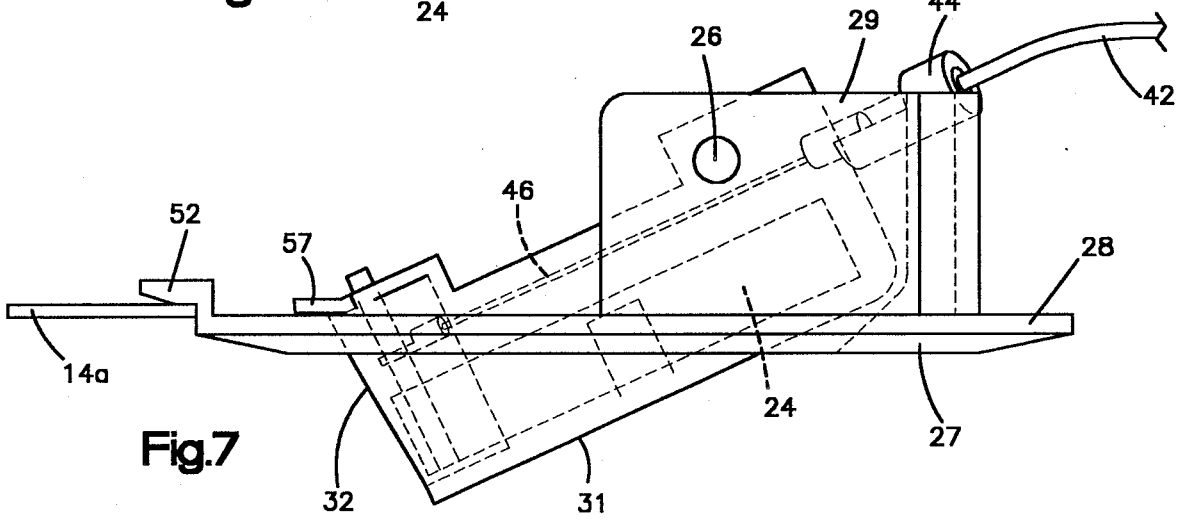
Figure 8:
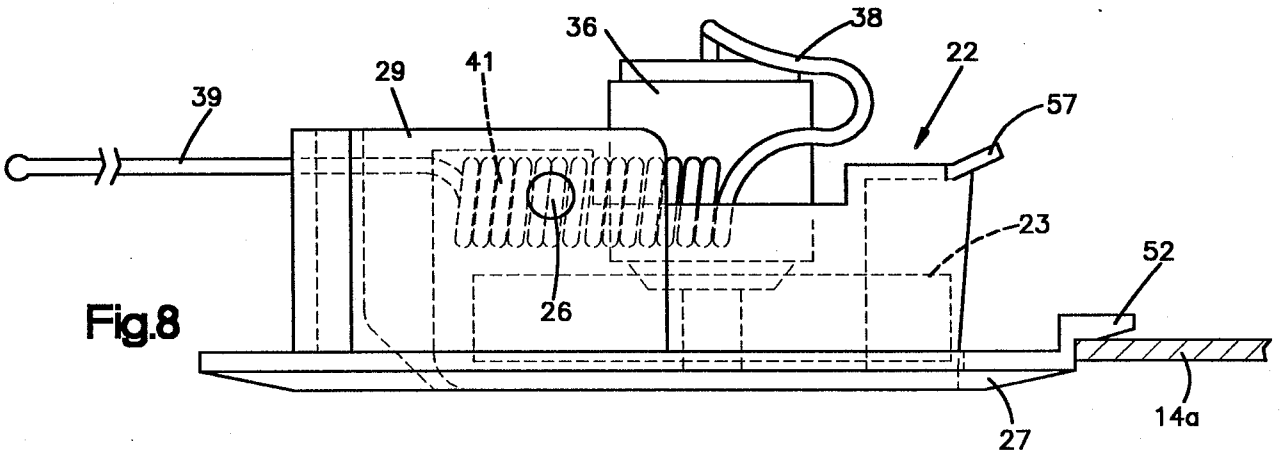
FIGS. 8 and 9 are end views of the thermostat end of the control unit, respectively illustrating the control in the retracted position and the extended operative position.
Figure 9:
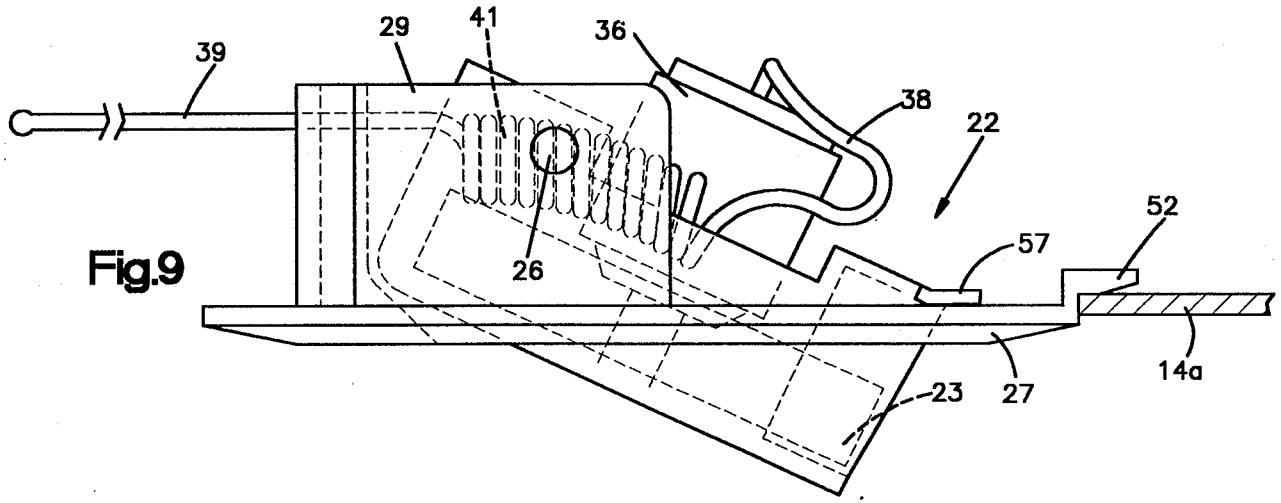

The control panel 22 is movable within the mounting frame between a retracted or recessed position illustrated in FIGS. 4, 6, and 8 and the operative or extended position illustrated in FIGS. 3, 7, and 9. In the retracted position, the lower surface 31 of the control panel is flush with the lower surface of the border portion 28. Further, the mounting frame and the control panel are proportioned so that the lower surface 31 of the control panel substantially fills the opening defined by the mounting frame when it is in a retracted position.

In the extended position, the front face 32 of the control panel extends down below the lower surface of the border portion 28, and is therefore accessible. Mounted on the control panel are two controls. The first control is a thermostat 36 of the capillary tube-type providing a capillary tube sensor 37. Mounted on the thermostat 36 is the operator 23 which is rotated to adjust the operating temperature of the thermostat.

The capillary tube provides a portion 38 which is movable along with the thermostat 36 between the extended and retracted positions. It also includes a second portion 39 which extends along the separator wall and is fixed against movement relative to such wall. Therefore, the portion 38 moves relative to the portion 39 when the control panel is moved between the retracted and the extended positions. The capillary tube is therefore provided with a coiled portion 41 which is sufficiently flexible to accommodate the movement without damaging the capillary tube or changing the operating temperature of the thermostat.

The control of the damper 21 is provided by a Bowen tube 42 which includes a sheath 43 mounted at one end on the control panel 22 within a mounting collar 44. The Bowen tube also includes a wire 46 which is connected to the operator 24 by a pivot connection 47. The operator is pivoted on the control panel by a pivot 48 and is movable from the position illustrated in FIG. 5 in an anticlockwise direction to a position in which the pivot is located at the point 49. Such movement of the operator 24 between the two limit positions causes the Bowen wire 46 to move back and forth along the sheath 42. The opposite end of the wire 46 is connected to the damper 21 and the opposite end of the sheath 42 is anchored with respect to the duct. Therefore, rotation of the operator 24 about the pivot 48 adjustably positions the damper 21 within the duct system and adjustably determines the proportion of the cooling provided by the evaporator which reaches the food storage compartment.

When the damper is moved in the fully open direction, the amount of cooling delivered to the food storage compartment increases and the differential temperature between the two compartments decreases. On the other hand, when a lesser amount of cooling provided by the evaporator is directed to the food storage compartment 12, a greater amount of the cooling is retained within the freezer compartment and a greater differential temperature exists. Therefore, adjustment of the damper controls the differential temperature between the two compartments. This effectively determines the temperature of the freezer compartment, since the temperature of the freezer compartment is referenced to the temperature in the food storage compartment. Here again, the flexibility of the Bowen tube accommodates the movement of the control panel between the extended and the retracted positions. Further, because one end of the sheath is anchored on the control panel and the other end is anchored in a fixed position relative to the duct, the movement of the control panel between these two positions does not change the adjustment of the damper In the illustrated embodiment, a power saver switch 51 is also mounted on the control panel.

In order to eliminate any projections down into the food storage compartment, a touch latch, schematically illustrated at 56, is mounted on the operator panel to hold the operator panel in the retracted position during the normal operation of the refrigerator. Such touch latch employs a spring system which extends the latch into a mating recess to hold the panel in the retracted position. However, when the forward portion of the control panel is again pressed in an upward direction, i.e., the direction toward the closed position, the latch automatically releases and allows the control panel to move to its extended position In the extended position, a tab 57 on the forward end of the control panel engages the mounting frame to limit the downward movement of the forward end of the control panel. A suitable touch latch 56 is marketed as a touch latch Part No. E-41020110, by Southco Fasteners, of Concordville, Pa.

With this invention, a simple, retractable control system is provided which can be accessed by the user when temperature adjustments are required. However, at all other times the controls are recessed within the wall structure and do not project into the food storage compartments. Consequently, the controls do not interfere with the placement of food within the storage compartments. Further, the controls are not accidentally damaged and the temperature settings are not inadvertently changed.

Further, by providing a touch latch system, the control can be completely recessed in the retracted position, and it is not necessary to provide a projecting handle or the like to allow the movement of the control to the extended position.

Although the preferred embodiment of this invention has been shown and described, it should be understood that various modifications and rearrangements of the parts may be resorted to without departing from the scope of the invention as disclosed and claimed herein.

What is claimed is:

1. A refrigerator apparatus comprising an insulated cabinet having walls defining a refrigeration compartment, a retractable control panel mounted for movement between a retracted position within said walls and an extended position in which it projects from said walls and is accessible within said compartment, adjustable temperature control means for controlling the temperature of said compartment and having an operator mounted on said control panel, said operator being accessible when said control panel is in said extended position and enclosed within said walls when said control panel is in said retracted position, the operation of said temperature control means being unaffected by movement of said control panel between said extended and retracted positions.

2. A refrigerator apparatus as set forth in claim 1, wherein said walls provide a wall portion along the upper side of said compartment, and said control panel and operator are enclosed within said wall portion when in said retracted position.

3. A refrigerator apparatus comprising an insulated cabinet having walls defining a freezer compartment and a separate non-frozen storage compartment, a retractable control panel mounted for movement between a retracted position within said walls and an extended position in which it projects from said walls and is accessible within one of said compartments, and adjustable temperature control means for controlling the temperatures in said compartments and having operators mounted on said control panel, said operators being accessible when said control panel is in said extended position and enclosed within said walls when said control panel is in said retracted position, the operation of said temperature control means being unaffected by movement with said control panel between said extended and retracted positions.

4. A refrigerator apparatus as set forth in claim 3, wherein releasable latch means are provided to retain said control panel in said recessed position, said latch means being releasable by a force on said control panel in the direction of movement toward said retracted position.

5. A refrigerator apparatus as set forth in claim 3, wherein said walls provide a wall portion along the upper side of said one compartment, and said control panel and operators are enclosed within said wall portion when in said retracted position.

6. A refrigerator apparatus as set forth in claim 5, wherein the lowest portion of said control panel is substantially flush with the surface of said wall portion when said control panel is in said retracted position whereby said control panel has no effect on the storage of items in said one compartment when said control panel is in said retracted position.

7. A refrigerator apparatus as set forth in claim 5, wherein said wall portion separates said compartments.

8. A refrigerator apparatus as set forth in claim 3 providing a refrigeration system, said control means including a thermostat providing a sensor sensing the temperature in said one compartment to control the operation of said refrigeration system and thereby control the temperature in said one compartment.

9. A refrigerator apparatus as set forth in claim 8, wherein said thermostat provides a body mounted on said control panel and movable therewith, said thermostat also providing a capillary tube sensor having a first portion movable with said control panel and a second portion fixed against movement relative to said one compartment, said capillary tube providing a flexible portion connecting said first and second portions permitting movement of said body with said control panel without causing damage to said capillary tube.

10. A refrigerator apparatus as set forth in claim 9, wherein said flexible portion is provided by coils formed in said capillary tube.

11. A refrigerator apparatus as set forth in claim 9, wherein said refrigerator system provides an evaporator and duct means operatively connecting said evaporator and said one compartment, said duct means providing adjustable damper means operable to control the portion of cooling reaching said one compartment and thereby adjustably controlling the temperature maintained in the other of said compartments, one of said operators being connected to adjust the position of said damper means.

12. A refrigerator apparatus as set forth in claim 11, wherein said damper means is connected to one of said operators by a Bowen tube.

13. A temperature control for refrigerator apparatus comprising a mounting frame having a side, said mounting frame being adapted to be mounted in a wall portion of a refrigerator with said side substantially flush with the surface of said wall portion, a movable frame member mounted on said mounting frame for movement between a retracted position recessed beyond said side and an extended position projecting beyond said side, and temperature control means having an operator mounted on said movable frame member positioned thereon for access when said movable frame member is in said extended position, the operation of said temperature control means being unaffected by the movement of said movable frame member between said extended and retracted positions.

14. A temperature control as set forth in claim 13, wherein said temperature control means includes a thermostat having a body mounted on said movable frame member and providing a temperature sensor extending from said movable frame member, said sensor providing a flexible portion accommodating movement of said body with said movable frame member.

15. A temperature control as set forth in claim 13, wherein said temperature control means includes a Bowen tube having one end mounted on said movable frame member, said Bowen tube being sufficiently flexible to accommodate movement of said movable frame member.

16. A temperature control as set forth in claim 13, wherein a touch latch is provided to releasably retain said movable frame member in said retracted position, said touch latch being released by pressure on said movable frame member in a direction toward said retracted position.

* * * * *